US009073653B2

(12) United States Patent
Cavazza et al.

(10) Patent No.: US 9,073,653 B2
(45) Date of Patent: Jul. 7, 2015

(54) WRAPPING METHOD AND UNIT FOR FOLDING A SHEET OF WRAPPING MATERIAL ABOUT A GROUP OF CIGARETTES

(75) Inventors: Luca Cavazza, Bologna (IT); Ivanoe Bertuzzi, Casalecchio di Reno (IT); Michele Squarzoni, Ferrara (IT); Andrea Biondi, Bologna (IT)

(73) Assignee: G.D SOCIETA'PER AZIONI, Bologna (IT)

( * ) Notice: Subject to any disclaimer, the term of this patent is extended or adjusted under 35 U.S.C. 154(b) by 866 days.

(21) Appl. No.: 13/322,694

(22) PCT Filed: May 24, 2010

(86) PCT No.: PCT/IB2010/001222

§ 371 (c)(1),
(2), (4) Date: Mar. 26, 2012

(87) PCT Pub. No.: WO2010/136869

PCT Pub. Date: Dec. 2, 2010

(65) Prior Publication Data

US 2012/0174534 A1 Jul. 12, 2012

(30) Foreign Application Priority Data

May 26, 2009 (IT) ..... BO2009A0339

(51) Int. Cl.
*B65B 19/22* (2006.01)
*B65B 51/10* (2006.01)
(Continued)

(52) U.S. Cl.
CPC ..... *B65B 19/223* (2013.01); *B65B 11/32* (2013.01); *B65B 51/10* (2013.01); *B65D 85/1072* (2013.01)

(58) Field of Classification Search
CPC ..... B65B 51/10; B65B 51/14; B65B 11/28; B65B 11/30; B65B 11/32; B65B 19/22; B65B 19/221–19/226
USPC ..... 53/461, 463, 466, 477, 228–234, 373.2, 53/373.7, 374.3, 374.8
See application file for complete search history.

(56) References Cited

U.S. PATENT DOCUMENTS 2,225,888 A * 12/1940 Rose ..... 53/463
3,380,227 A 4/1968 Youngman et al.
(Continued)

FOREIGN PATENT DOCUMENTS

CN 101269706 A 9/2008
DE 1636226 A1 4/1971
(Continued)

OTHER PUBLICATIONS

International Search Report in International Application No. PCT/IB2010/001222, dated Nov. 4, 2010.

*Primary Examiner* — Thanh Truong
*Assistant Examiner* — Joshua Kotis
(74) *Attorney, Agent, or Firm* — Marshall, Gerstein & Borun LLP

(57) ABSTRACT

A method and unit for folding a sheet of wrapping material about a group of cigarettes includes feeding the cigarettes and wrapping material into a pocket of a wrapping conveyor so the sheet of wrapping material folds into a U inside the pocket and has an outer end projecting from the pocket, and an inner end resting on a lateral wall of the cigarettes. The method also includes folding the inner end 90° so the inner end is perpendicular to the lateral wall. The method also includes folding the outer end into an L inside the pocket, onto the lateral wall of the cigarettes and onto the inner end perpendicular to the lateral wall so as to superimpose the outer end and the inner end and impart a tubular shape to the sheet of wrapping material. The method also includes heat sealing the outer and inner ends together.

13 Claims, 9 Drawing Sheets

(51) Int. Cl.

| | |
|---|---|
| ***B65B 11/32*** | (2006.01) |
| *B65D 85/10* | (2006.01) |

(56) References Cited

U.S. PATENT DOCUMENTS

| | | | | | |
|---|---|---|---|---|---|
| 3,810,314 | A * | 5/1974 | Anderson | 53/372.5 |
| 3,813,849 | A * | 6/1974 | Stambera et al. | 53/234 |
| 4,092,816 | A * | 6/1978 | Seragnoli | 53/234 |
| 4,161,093 | A * | 7/1979 | Focke | 53/228 |
| 4,183,191 | A * | 1/1980 | Focke | 53/225 |
| 4,711,065 | A * | 12/1987 | Focke et al. | 53/170 |
| 4,718,216 | A | 1/1988 | Focke et al. | |
| 5,003,755 | A * | 4/1991 | Draghetti | 53/466 |
| 5,694,738 | A * | 12/1997 | Shigeta | 53/234 |
| 6,047,529 | A * | 4/2000 | Draghetti | 53/466 |
| 6,820,398 | B2 * | 11/2004 | Tale' et al. | 53/466 |
| 6,860,089 | B2 | 3/2005 | VanAlstine | |
| 8,037,664 | B2 * | 10/2011 | Squarzoni et al. | 53/466 |
| 8,266,877 | B2 * | 9/2012 | Biondi et al. | 53/466 |
| 8,418,431 | B2 * | 4/2013 | Bertuzzi et al. | 53/466 |
| 8,474,612 | B2 * | 7/2013 | Bertuzzi et al. | 206/264 |
| 8,556,072 | B2 * | 10/2013 | Bertuzzi et al. | 206/265 |
| 8,590,701 | B2 * | 11/2013 | Bertuzzi et al. | 206/268 |
| 8,621,832 | B2 * | 1/2014 | Bretthauer | 53/557 |
| 2003/0192287 | A1 | 10/2003 | VanAlstine | |

FOREIGN PATENT DOCUMENTS

| | | | | |
|---|---|---|---|---|
| DE | 2711473 | A1 | 10/1977 | |
| DE | 2854443 | A1 | 7/1980 | |
| DE | 43 20 309 | A1 | 1/1994 | |
| EP | 0197368 | A2 | 10/1986 | |
| EP | 1 459 983 | A1 | 9/2004 | |
| EP | 1 686 060 | A1 | 8/2006 | |
| EP | 1 960 269 | A1 | 8/2008 | |
| EP | 1 997 735 | A2 | 12/2008 | |
| EP | 2008935 | A1 | 12/2008 | |
| FR | 2 138 102 | A1 | 12/1972 | |
| GB | 2038765 | A | 7/1980 | |
| JP | 63294317 | A | 12/1988 | |
| WO | WO-98/49072 | A1 | 11/1998 | |
| WO | WO 2007/132330 | * | 11/2007 | B65B 11/36 |
| WO | WO 2007/132330 | A1 * | 11/2007 | B65B 11/36 |
| WO | WO-2007/132330 | A1 | 11/2007 | |
| WO | WO-2009/098297 | A1 | 8/2009 | |
| WO | WO-2009/130227 | A1 | 10/2009 | |

* cited by examiner

WRAPPING METHOD AND UNIT FOR FOLDING A SHEET OF WRAPPING MATERIAL ABOUT A GROUP OF CIGARETTES

CROSS-REFERENCE TO RELATED APPLICATIONS

This application is the U.S. national phase of PCT/IB2010/0012222, filed May 24, 2010, which claims the benefit of Italian Patent Application No. BO2009A 000339, filed May 26, 2009.

TECHNICAL FIELD

The present invention relates to a wrapping method and unit for folding a sheet of wrapping material about a group of cigarettes.

BACKGROUND ART

A packet of cigarettes normally comprises an inner package defined by a group of cigarettes wrapped in a sheet of inner packing material; and an outer package enclosing the inner package, and which may be cup-shaped and made from a sheet of outer packing material folded about the inner package (soft packet of cigarettes), or may be defined by a rigid hinged-lid box formed by folding a rigid blank about the inner package (rigid packet of cigarettes).

In a conventional packet of cigarettes, the group of cigarettes is wrapped internally in a rectangular sheet of foil inner wrapping material with no glue, and is packed externally in a rectangular sheet of outer packing material that is stabilized using glue.

Tobacco is highly sensitive to environment. That is, in contact with the atmosphere, its organic characteristics tend to vary alongside variations in humidity (by losing or absorbing too much moisture) or due to evaporation of the volatile substances with which the tobacco is impregnated (especially in the case of aromatic cigarettes treated with spices such as cloves). To preserve the tobacco, packets of cigarettes are therefore cellophane-wrapped, i.e. wrapped in a heat-sealed overwrapping of airtight plastic material. This, however, may not always be sufficient to fully preserve the tobacco in the packet, especially if the packet is consumed some time after manufacture. Moreover, when the packet is unsealed, the overwrapping is removed, thus exposing the tobacco to the atmosphere, and, if the cigarettes are not consumed soon after the packet is unsealed, the organic characteristics of the remaining cigarettes may deteriorate.

In an attempt to eliminate this drawback, U.S. Pat. No. 4,300,676A1 proposes a rigid packet of cigarettes, in which the inner package is airtight, and comprises a sheet of airtight heat-seal wrapping material having a cigarette extraction opening closed by a reusable cover flap.

It has been observed that folding the sheet of inner wrapping material about the group of cigarettes may damage the ends of the cigarettes and result in localized deformation (of both the filter-tipped and plain ends, i.e. where the tobacco is exposed), and/or tobacco spill (i.e. tobacco fallout, obviously only from the plain ends). This applies in particular to the corner cigarettes in the group, though damage is also evident in all the outermost cigarettes, i.e. located along the fold lines of the sheet of inner wrapping material. Folding a sheet of airtight inner wrapping material is particularly harmful, by being thicker (and therefore stiffer) than conventional sheets of foil wrapping material. Heat sealing the superimposed portions of the sheet of inner wrapping material may also damage the cigarettes underneath, in that, to achieve a good-quality (i.e. airtight) seal quickly (modern packing machines operate at a rate of 500 packets a minute, which means heat sealing must be completed in a fraction of a second), the superimposed portions must be subjected to considerable pressure—which is inevitably transmitted to and may cause permanent deformation of the cigarettes underneath—and must be heated to a high temperature, with the obvious danger of possibly overheating the tobacco in the cigarettes underneath (thus resulting in local drying and alteration of the organic characteristics of the tobacco).

U.S. Pat. No. 3,813,849A1 discloses an automatic packaging machine for macaroni, or the like, in which the machine includes a vertical disposed, rotatable conveyor wheel with adjacent arranged stations for filling, weighting, sealing and closing; the wheel has pockets in the periphery for receiving packaging material and the articles to be packed, and associated with the wheel are folding and closing mechanism for effecting individual steps of the operation.

DISCLOSURE OF THE INVENTION

It is an object of the present invention to provide a wrapping method and unit for folding a sheet of wrapping material about a group of cigarettes, which method and unit are cheap and easy to implement and designed to eliminate the above drawbacks.

According to the present invention, there are provided a wrapping method and unit for folding a sheet of wrapping material about a group of cigarettes, as claimed in the accompanying claims.

BRIEF DESCRIPTION OF THE DRAWINGS

A number of non-limiting embodiments of the present invention will be described by way of example with reference to the accompanying drawings, in which.

PREFERRED EMBODIMENTS OF THE INVENTION

Figure 1:
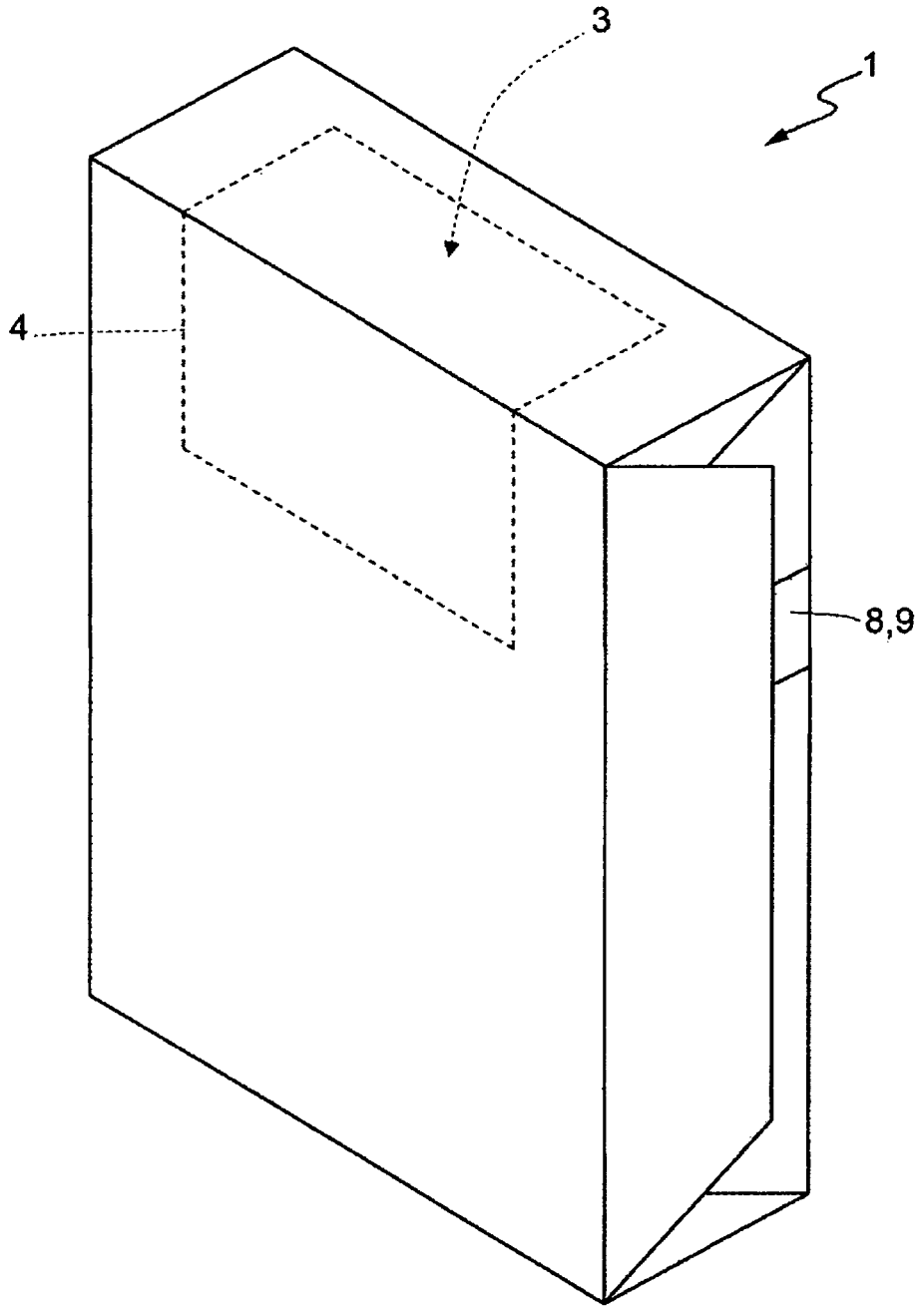
FIG. 1 shows a front view in perspective of a package of cigarettes formed using the wrapping method according to the present invention.
Figure 2:
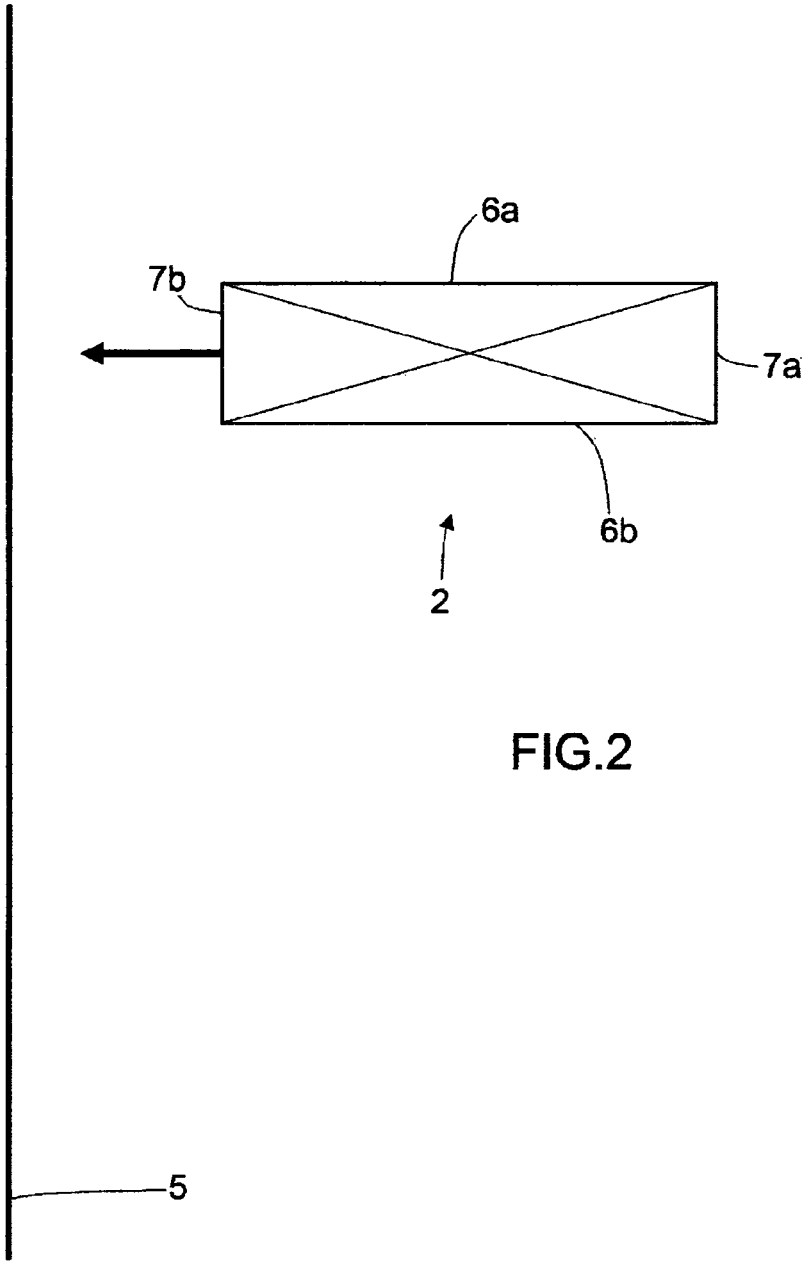
FIGS. 2-6 show a number of steps in the wrapping method according to the present invention, for folding a sheet of wrapping material about a group of cigarettes to obtain the FIG. 1 package of cigarettes.

Number 1 in FIG. 1 indicates as a whole a package of cigarettes, e.g. of the type described in U.S. Pat. No. 4,300,676A1. Package 1 of cigarettes encloses a parallelepiped-shaped group 2 of cigarettes (shown schematically in FIGS. 2-6), and has at the top and front a cigarette extraction opening 3 bounded by a tear line 4 and extending over a portion of a front wall of package 1 and a portion of a top wall of package 1. To unseal package 1, the user tears the package along tear line 4 to eliminate the package at extraction opening 3 and so access the cigarettes in group 2 through extraction opening 3.

As described in U.S. Pat. No. 4,300,676A1, package 1 of cigarettes as described above may be inserted inside a known rigid, hinged-lid cigarette packet, and extraction opening 3 may be closed by a reusable open-close cover flap fixed to package 1 using non-dry, re-stick adhesive.

Package 1 is formed by folding a sheet 5 of wrapping material (shown schematically in FIGS. 2-6), which is rectangular, is made of airtight, heat-seal plastic material (or composite multilayer material with at least one layer of plastic material), and is folded directly about and in direct contact with group 2 of cigarettes. Once sheet 5 of wrapping material is folded about group 2 of cigarettes to form package 1, the shape of package 1 is stabilized by heat sealing the superimposed portions of sheet 5 of wrapping material.

Before being folded about group 2 of cigarettes, sheet 5 of wrapping material is cut to define extraction opening 3, and is then fitted, if necessary, with the cover flap gummed on the underside, i.e. the underside surface of the cover flap is coated with re-stick adhesive, which glues the portion of sheet 5 of wrapping material inside extraction opening 3 permanently to the cover flap, and, outside extraction opening 3, glues sheet 5 of wrapping material detachably to the cover flap.

In another embodiment, not shown, package 1 comprises a U-shaped cardboard stiffener inserted inside package 1, contacting group 2 of cigarettes, and which comprises a rectangular central panel positioned contacting a bottom wall of group 2 defined by the ends of the cigarettes (or positioned contacting a front wall of group 2 defined by the cylindrical lateral walls of the cigarettes); and two lateral wings connected to the central panel along two fold lines and positioned contacting the minor lateral walls of group 2 defined by the cylindrical lateral walls of the cigarettes.

FIGS. 2-6 show steps in the folding of sheet 5 of wrapping material about group 2 of cigarettes, which has two opposite lateral walls 6*a*, 6*b* defined by the cylindrical lateral walls of the cigarettes, and two opposite end walls 7*a*, 7*b* defined by the ends of the cigarettes.

Figure 3:
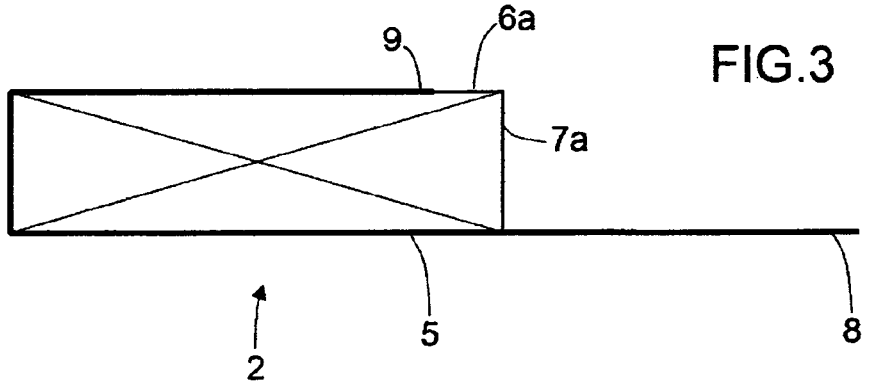
Figure 4:
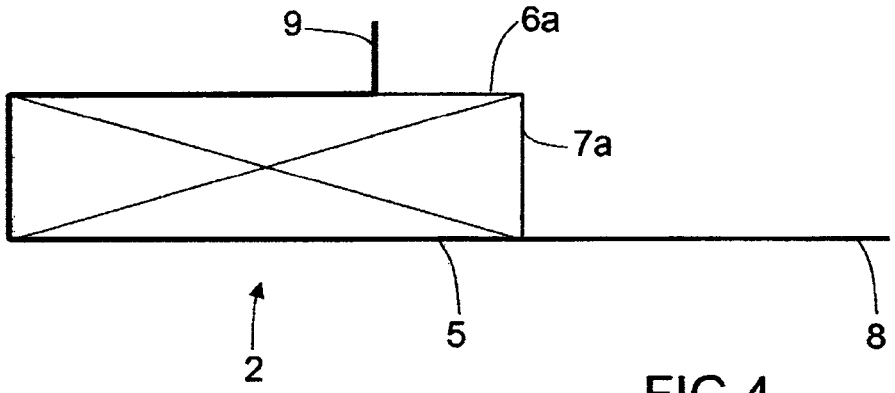
Figure 5:
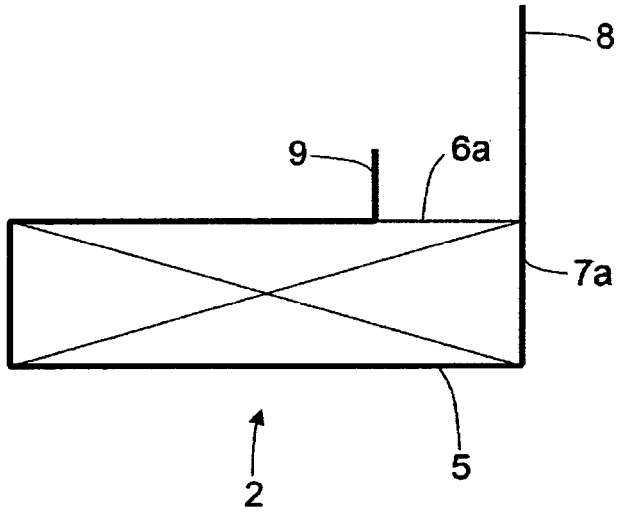
Figure 6:
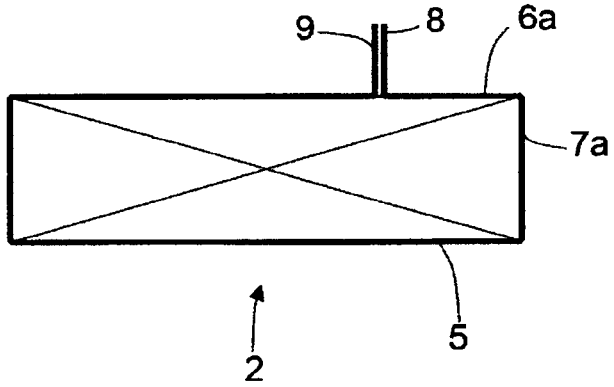

To begin with, end wall 7*b* of group 2 of cigarettes is brought into contact with the flat sheet 5 of wrapping material (FIG. 2) so that the sheet of wrapping material folds into a U about group 2 of cigarettes (FIG. 3). It is important to note that sheet 5 of wrapping material is fed asymmetrically in front of group 2 of cigarettes, so as to form two differently arranged portions 8 and 9 of different lengths. As shown in FIG. 3, once folded into a U about group 2 of cigarettes, sheet 5 of wrapping material has an outer portion 8 projecting from group 2 of cigarettes; and an inner portion 9 resting on lateral wall 6*a* of group 2. As shown in FIG. 4, inner portion 9 is folded 90° with respect to lateral wall 6*a* of group 2, so as to be perpendicular to lateral wall 6*a*. As shown in FIG. 5, outer portion 8 is folded 90° onto end wall 7*a* of group 2. As shown in FIG. 6, outer portion 8 is folded into an L onto lateral wall 6*a* of group 2 and onto inner portion 9 perpendicular to lateral wall 6*a*, so as to superimpose outer portion 8 and inner portion 9 and impart a tubular shape to sheet of wrapping material. The superimposed portions of outer portion 8 and inner portion 9 are heat sealed to stabilize the tubular shape of sheet 5 of wrapping material; and, finally, the heat-sealed, superimposed portions 8 and 9 are folded 90° onto lateral wall 6*a* of group 2 (as shown partly in FIG. 1).

Figure 7:
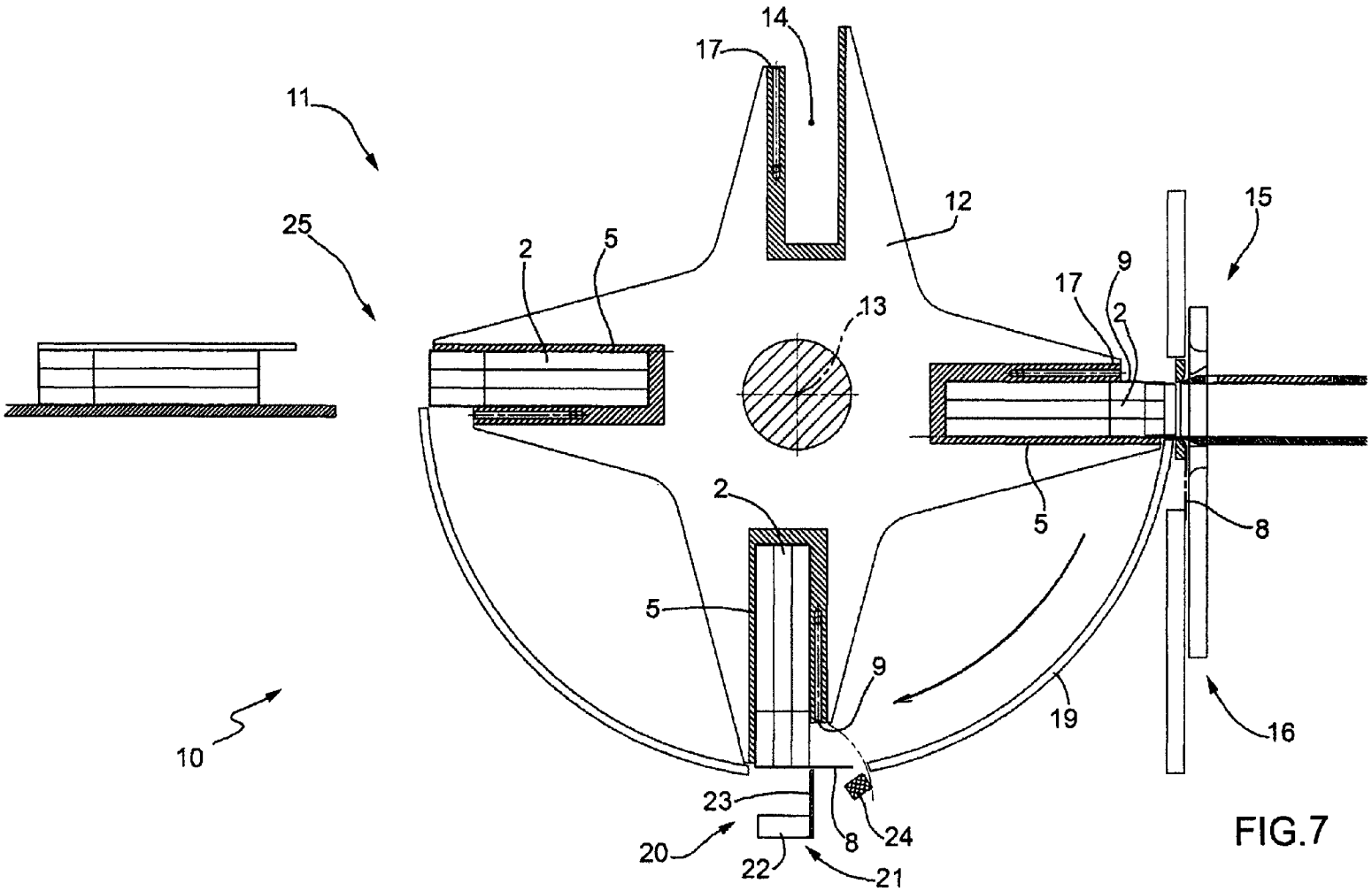
FIG. 7 shows a schematic front view, with parts removed for clarity, of a wrapping unit in accordance with the present invention, forming part of a cigarette packing machine, and for producing the FIG. 1 package of cigarettes.

Number 10 in FIG. 7 indicates as a whole a packing machine for producing the FIG. 1 package 1 of cigarettes as shown in FIGS. 2-6.

Packing machine 10 comprises a group-forming unit (not shown in FIG. 7) for successively forming groups 2 of cigarettes; and a wrapping unit 11 (shown in FIG. 7) for wrapping and heat sealing a respective sheet 5 of wrapping material about each group 2 of cigarettes. It is important to note that packing machine 10 could simply comprise the group-forming unit (not shown in FIG. 7) and wrapping unit 11; in which case, package 1 as described above would be a marketable finished product. Alternatively, packing machine 10 could comprise a further known packing station for packing each package 1 in a respective outer package, which may be cup-shaped and comprise a sheet of outer packing material folded about package 1 (soft packet of cigarettes), or may comprise a rigid, hinged-lid box formed by folding a rigid blank about package 1 (rigid packet of cigarettes).

Wrapping unit 11 in FIG. 7 comprises a wrapping wheel 12 which receives groups 2 of cigarettes from the group-forming unit (not shown), rotates in steps (clockwise in FIG. 7) about a horizontal axis of rotation 13 perpendicular to the FIG. 7 plane, and supports a number of peripheral pockets 14, each for housing a group 2 of cigarettes.

Each pocket 14 on wrapping wheel 12 receives a group 2 of cigarettes together with a corresponding sheet 5 of wrapping material at an input station 15. More specifically, sheet 5 of wrapping material is fed to input station 15 by a feed device 16, so as to be positioned in front of the inlet of pocket 14 and perpendicular to the travelling direction of group 2 of cigarettes; and, as group 2 is pushed inside pocket 14, sheet 5 of wrapping material is intercepted by group 2 and folds gradually into a U about group 2 as this is inserted inside pocket 14. As stated, each sheet 5 of wrapping material is fed to input station 15 so as to be positioned asymmetrically in front of the inlet of pocket 14 of wrapping unit 12. In other words, the centreline of sheet 5 of wrapping material is offset with respect to the centreline of pocket 14 of wrapping unit 12 at input station 15, so that, when folded into a U about group 2, sheet 5 of wrapping material has an outer portion 8 projecting from pocket 14, and an inner portion 9 opposite outer portion 8 and resting on lateral wall 6*a* of group 2 inside pocket 14.

Each pocket 14 has a U-shaped longitudinal section, and comprises an end wall, and two opposite parallel lateral walls. One lateral wall of each pocket 14, contacting lateral wall 6*a* of corresponding group 2 of cigarettes, is shorter than the opposite lateral wall, so as to leave inner portion 9 of sheet 5 of wrapping material exposed, and terminates with a transverse suction support 17 perpendicular to the lateral wall and designed to lift and retain the inner portion 9 of sheet 5 of wrapping material by suction. More specifically, a conduit 18 (shown more clearly in FIGS. 8 and 9) terminates at transverse support 17 and is connectable to a suction source. At input station 15, once sheet 5 of wrapping material is folded into a U about group 2, inner portion 9 of sheet 5 of wrapping material is folded 90° with respect to lateral wall 6*a* of group 2, so that inner portion 9 is perpendicular to lateral wall 6*a*, and is retained by suction in this position by and resting against transverse support 17. In other words, folding inner portion 9 ninety degrees with respect to lateral wall 6*a* of group 2 also comprises drawing inner portion 9 by suction onto transverse suction support 17 of pocket 14. It is important to note that inner portion 9 may be folded 90° with respect to lateral wall 6*a* of group 2 solely by suction by transverse support 17, or by combining suction by transverse support 17 with the action of a radially-moving folding device (not shown).

A circular folding rail 19 immediately downstream from input station 15 provides for folding outer portion 8 ninety degrees onto end wall 7*a* of group 2, as shown in FIG. 5. More specifically, as pocket 14 rotates out of input station 15, outer portion 8 strikes folding rail 19 and is thus folded.

At a folding and heat seal station 20 downstream from input station 15, the tubular shape of sheet 5 of wrapping material is completed and stabilized by heat sealing.

Folding and heat seal station 20 comprises a movable folding device 21, which is movable radially (i.e. perpendicular to axis of rotation 13) between a rest position (FIG. 7), in which movable folding device 21 is positioned outwards of the rotation path of pockets 14, and a folding position (FIGS. 8 and 9), in which movable folding device 21 engages the group 2 of cigarettes inside pocket 14. Movable folding device 21 is L-shaped, and comprises a tangent pad 22 which, in the folding position (FIGS. 8 and 9), rests against end wall 7*a* of group 2; and a radial blade 23 for folding outer portion 8 of sheet 5 of wrapping material. In other words, in the folding position (FIGS. 8 and 9), movable folding device 21 is positioned contacting lateral wall 6*a* of group 2, with outer portion 8 of sheet 5 of wrapping material in between, and grips inner portion 9 and outer portion 8 against transverse support 17.

Figure 8:
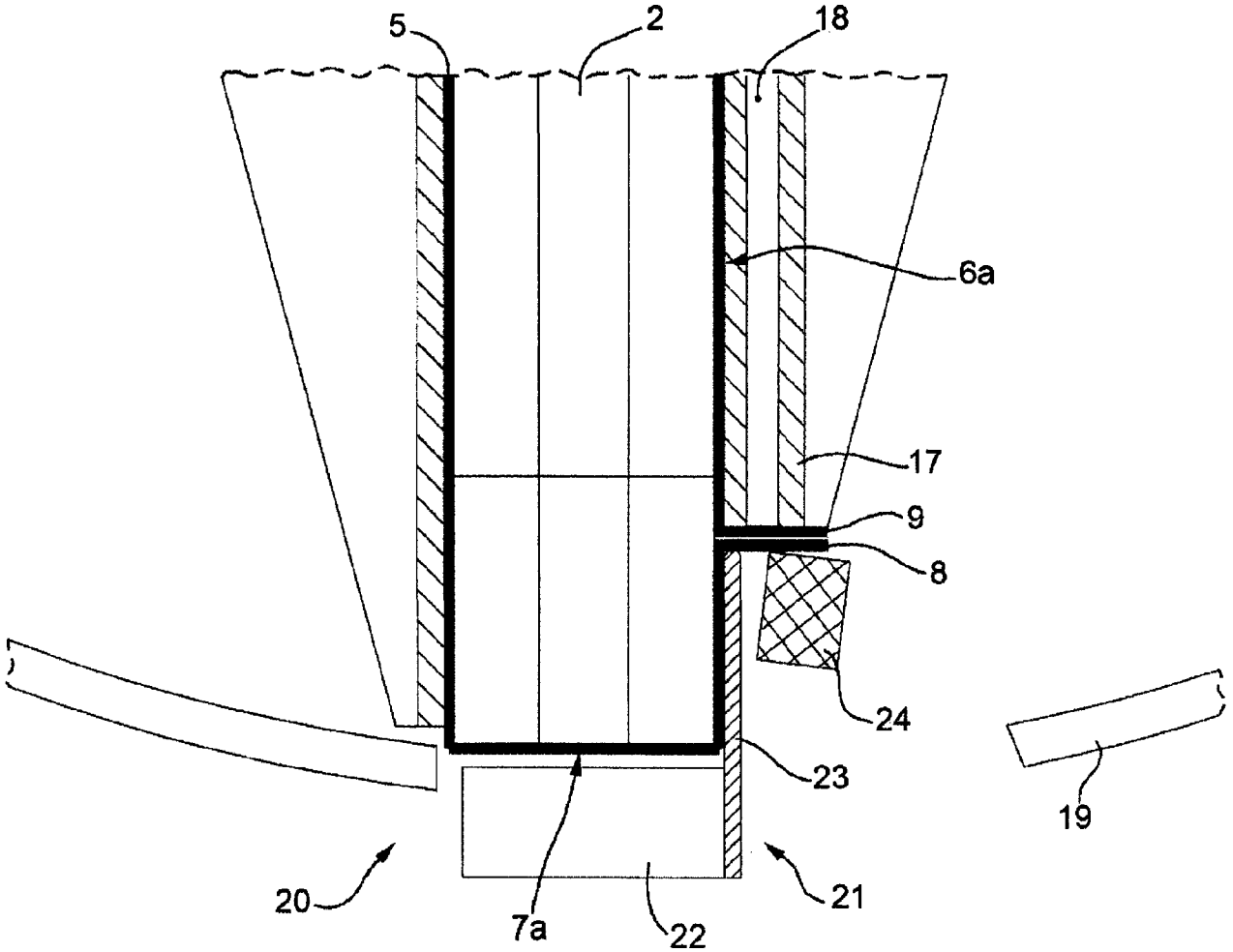
FIGS. 8 and 9 show larger-scale views of a heat-seal and wrapping station of the FIG. 7 wrapping unit at two different operating stages.

As shown in FIG. 8, movable folding device 21 folds outer portion 8 into an L onto lateral wall 6*a* of group 2 and against inner portion 9 perpendicular to lateral wall 6*a* and resting against transverse support 17, so as to superimpose outer portion 8 and inner portion 9 and impart a tubular shape to sheet 5 of wrapping material. The purpose of pad 22 is to press sheet 5 of wrapping material against end wall 7*a* of group 2, and so prevent creasing of sheet 5 at end wall 7*a* when folding outer portion 8.

Folding and heat seal station 20 also comprises a movable sealing device 24 which rotates between a rest position (FIG. 7), in which movable sealing device 24 is located outwards of the rotation path of pockets 14, and a sealing position (FIG. 9), in which movable sealing device 24 grips the superimposed portions of outer portion 8 and inner portion 9 against transverse support 17, and heat seals them by applying heat and pressure.

Figure 9:
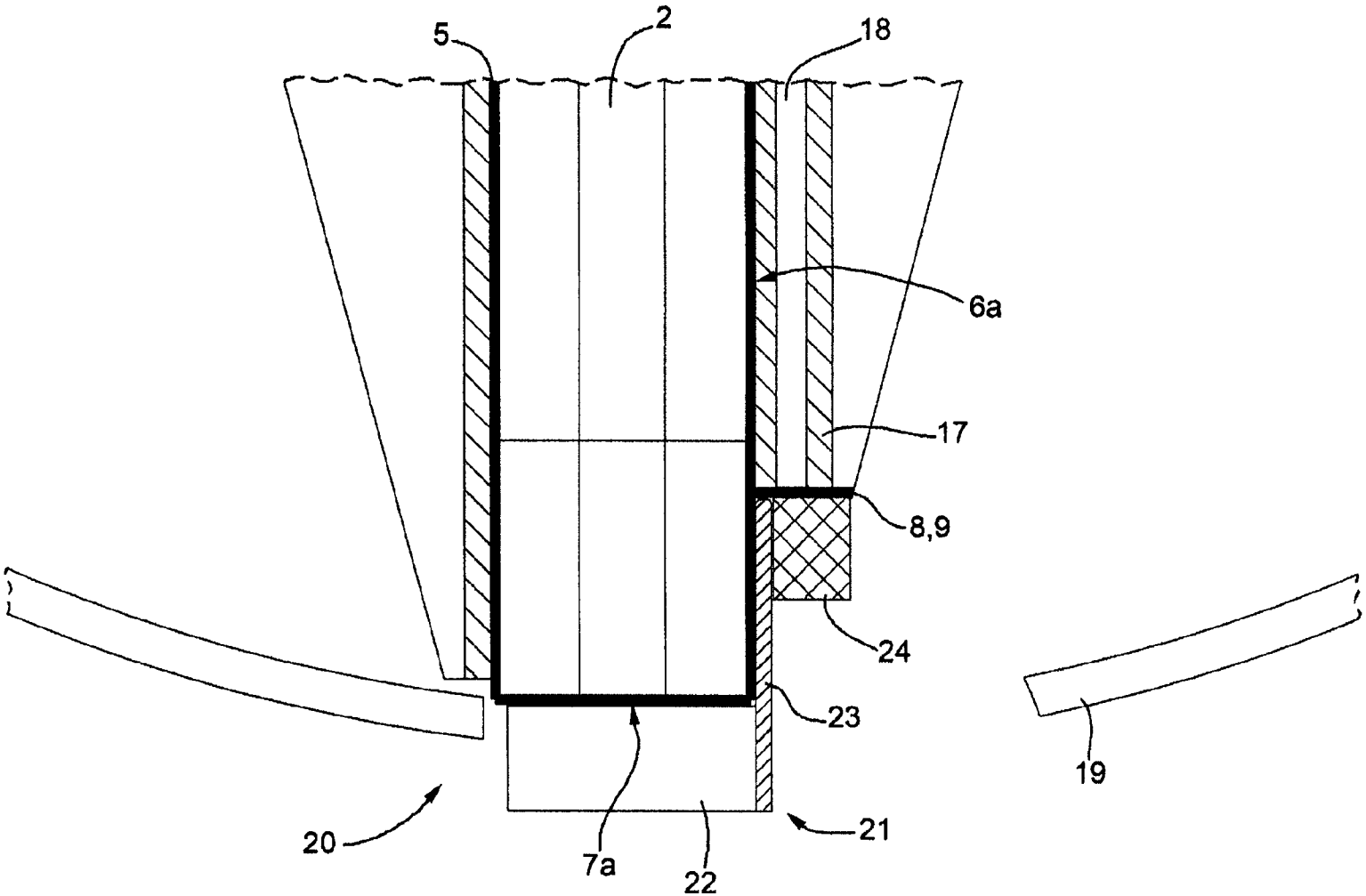
Figure 10:
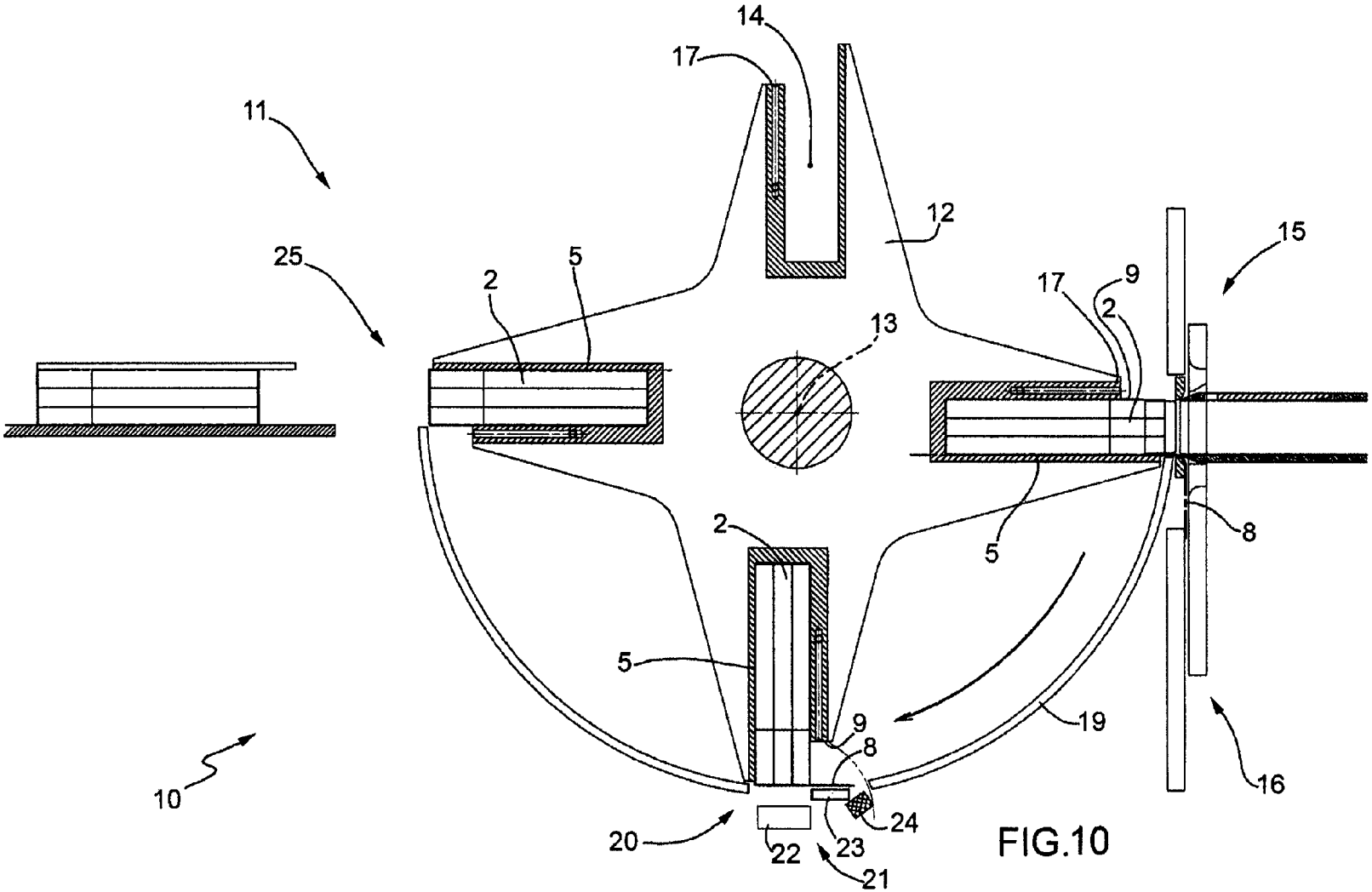
FIG. 10 shows a schematic front view, with parts removed for clarity, of an alternative embodiment of the FIG. 7 wrapping unit.
Figure 11:
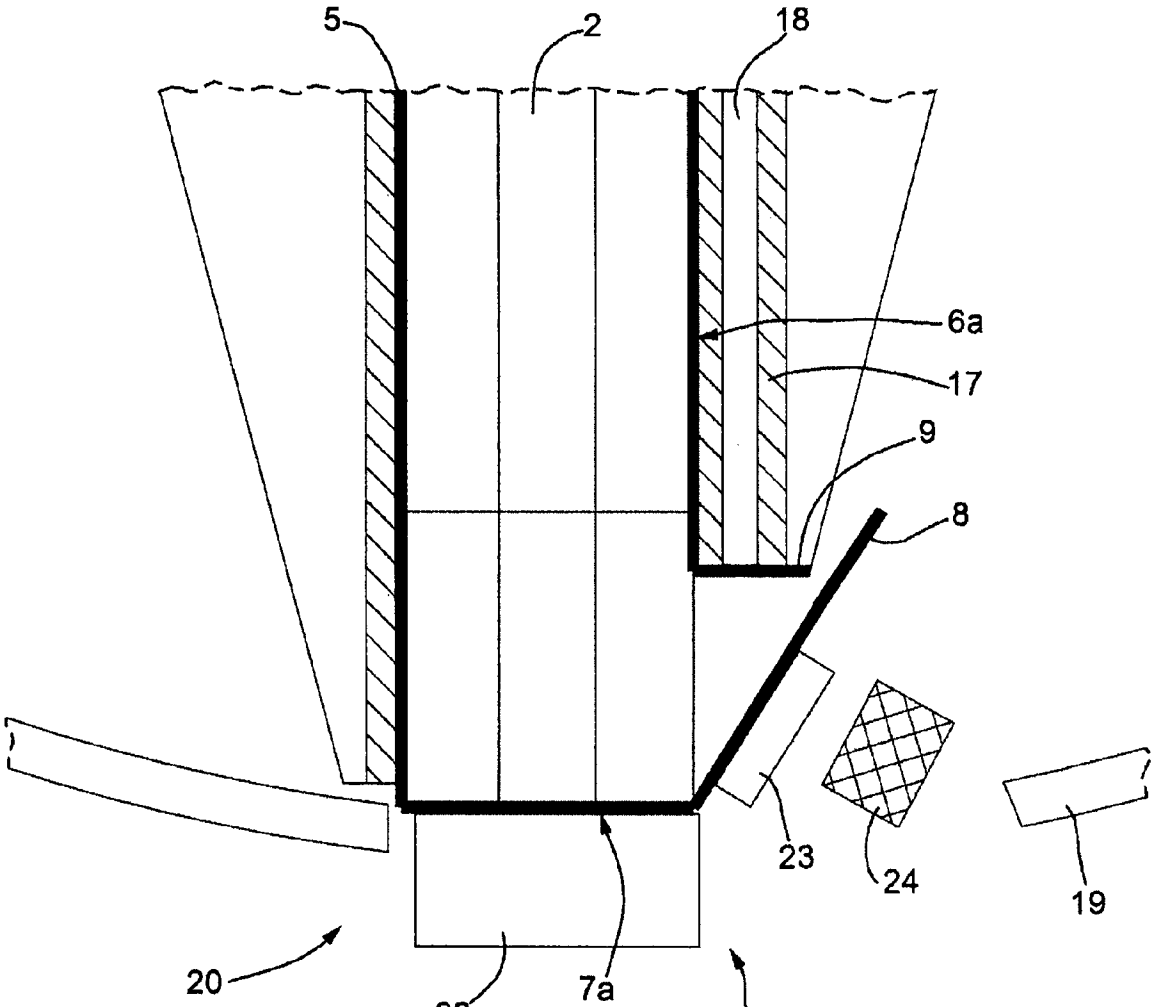
FIGS. 11 and 12 show larger-scale views of a heat-seal and wrapping station of the FIG. 10 wrapping unit at two different operating stages.
Figure 12:
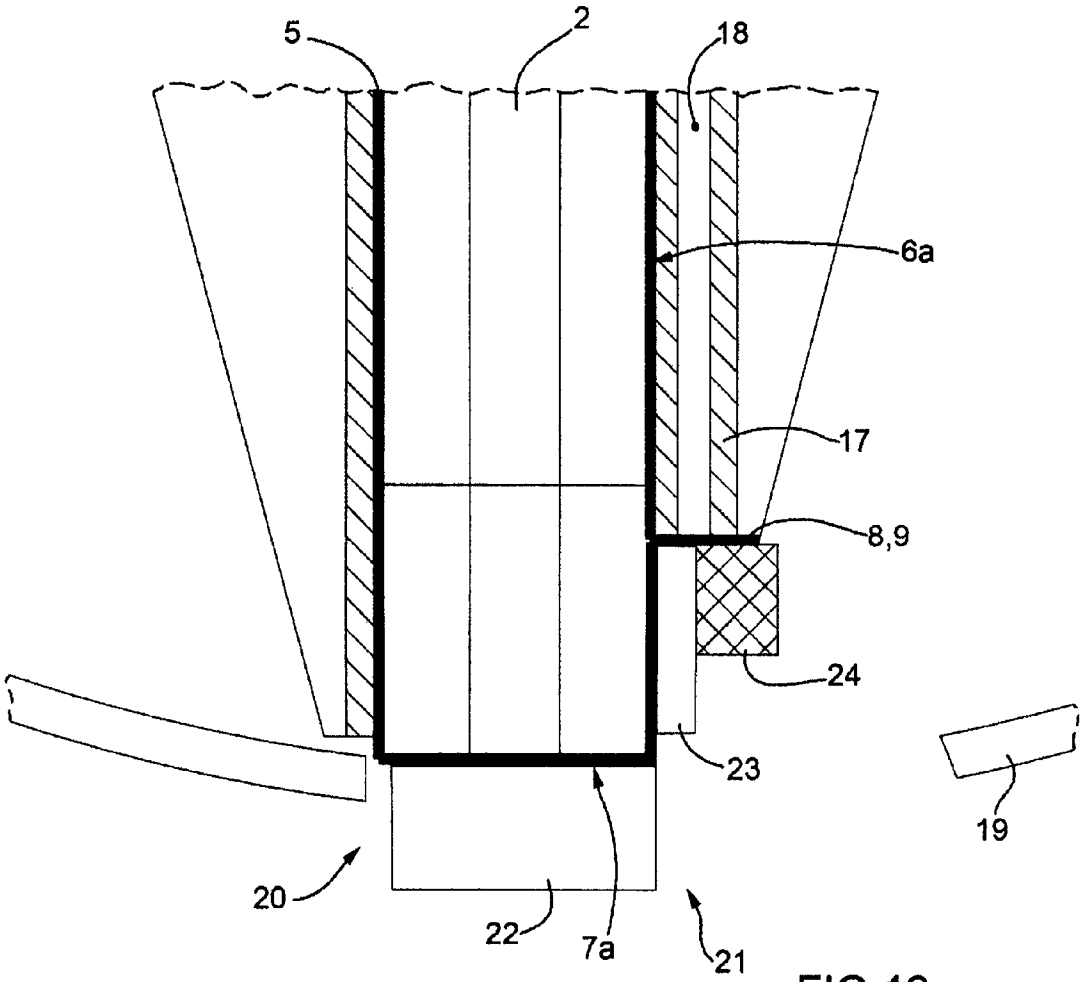

The FIG. 10-12 embodiment differs from the one in FIGS. 7-9 as regards the design of movable folding device 21. In the FIG. 7-9 embodiment, movable folding device 21 combines pad 22 and blade 23, and translates radially between the rest position (FIG. 7) and the folding position (FIGS. 8 and 9); whereas, in the FIG. 10-12 embodiment, movable folding device 21 only comprises blade 23, and rotates between the rest position (FIG. 10) and the folding position (FIGS. 11 and 12), and pad 22 is separate from and independent of movable folding device 21, and translates radially between the rest position (FIG. 10) and the folding position (FIGS. 11 and 12).

At an output station 25 downstream from folding and heat seal station 20, group 2 of cigarettes, together with the tubular sheet 5 of wrapping material, is expelled from pocket 14 of wrapping wheel 12 and fed to further known folding devices (not shown), which finish folding sheet 5 of wrapping material about group 2 of cigarettes to form package 1, the finished form of which is stabilized by heat sealing. The further known folding devices (not shown) may, for example, be of the type described in Patent Application EP2008935A1.

In wrapping unit 11 as described above, folding sheet 5 of wrapping material (particularly outer portion against inner portion 9) produces very little mechanical stress on, and therefore no damage to, the cigarettes in group 2. Moreover, when heat sealing the superimposed portions of portions 8 and 9, sheet 5 of wrapping material, as opposed to being pressed against group 2 of cigarettes, is gripped between two metal parts (transverse support 17 and sealing device 24). Which means the superimposed portions of portions 8 and 9 can be heat sealed by applying considerable pressure and at high temperature, with no damage to the cigarettes in group 2, thus ensuring a high-quality, fast seal (compatible with the demands of modern, fast-operating packing machines).

The invention claimed is:

1. A method of folding a sheet of wrapping material about a group of cigarettes, the method comprising the steps of:

feeding the group (2) of cigarettes and the sheet (5) of wrapping material into a pocket (14) of a wrapping conveyor (12), so the sheet (5) of wrapping material folds into a U-shape inside the pocket (14) and has an outer end (8) projecting from the pocket (14) and from the group (2) of cigarettes, and an inner end (9) resting on a lateral wall (6*a*) of the group (2) of cigarettes;

folding, by means of a first folding device, the inner end (9) 90° with respect to the first lateral wall (6*a*) of the group (2) of cigarettes, so the inner end (9) is perpendicular to the first lateral wall (6*a*) and projects perpendicularly from an intermediate portion of the first lateral wall (6*a*);

folding, by means of a second folding device (21), the outer end (8) into an L-shape onto the first lateral wall (6*a*) of the group (2) of cigarettes and onto the inner end (9) perpendicular to the first lateral wall (6*a*), so as to superimpose the outer end (8) and the inner end (9) and impart a tubular shape to the sheet (5) of wrapping material; and heat sealing the outer end (8) and inner end (9) to each other.

2. The method as claimed in claim 1, and comprising the further steps of:

feeding the sheet (5) of wrapping material asymmetrically in front of an inlet of the pocket (14); and inserting the group (2) of cigarettes into the pocket (14) together with the sheet (5) of wrapping material, which folds into a U-shape about the group (2) of cigarettes.

3. The method as claimed in claim 1, wherein the step of folding the inner end (9) 90° with respect to the first lateral wall (6*a*) of the group (2) of cigarettes comprises drawing the inner end (9) by suction onto a transverse suction support (17) of the pocket (14).

4. The method as claimed in claim 1, and comprising the further step of folding the outer end (8) 90° onto an end wall (7*a*), outside the pocket (14), of the group (2) of cigarettes before folding the outer end (8) into an L-shape onto the first lateral wall (6*a*) of the group (2) of cigarettes.

5. The method as claimed in claim 1, wherein the step of folding the outer end (8) comprises the further step of moving a movable folding device (21) towards the first lateral wall (6*a*) of the group (2) of cigarettes, so that, in a folding position, the movable folding device (21) is positioned contacting the first lateral wall (6*a*) of the group (2) of cigarettes, with the outer end (8) of the sheet (5) of wrapping material in between.

6. The method as claimed in claim 5, wherein the pocket (14) comprises a transverse support (17), on which the inner end (9) rests; and, in the folding position, the movable folding device (21) grips the inner end (9) and the outer end (8) against the transverse support (17).

7. The method as claimed in claim 5, wherein the step of folding the outer end (8) comprises the further step of placing a pad (22) against an end wall (7*a*), outside the pocket (14), of the group (2) of cigarettes.

8. The method as claimed in claim 7, wherein the pad (22) is integral with the movable folding device (21), and moves together with the movable folding device (21) in a translatory movement.

9. The method as claimed in claim 7, wherein the pad (22) is separate and independent of the movable folding device (21), and moves in a translatory movement.

10. The method as claimed in claim 9, wherein the movable folding device (21) moves in a rotary movement.

11. The method as claimed in claim 1, wherein the pocket (14) comprises a transverse support (17), on which the inner end (9) rests; the step of heat sealing the outer end (8) and the inner end (9) to each other comprises the further step of moving a movable sealing device (24) towards the outer and inner ends (8, 9) to grip the outer and inner ends (8, 9) against the transverse support (17).

12. The method as claimed in claim 11, wherein the movable sealing device (24) moves in a rotary movement.

13. A wrapping unit for folding a sheet of wrapping material about a group of cigarettes, the unit (11) comprising:

a wrapping conveyor (12) having at least one pocket (14);

an input station (15) for feeding the group (2) of cigarettes and the sheet (5) of wrapping material into the pocket (14), so the sheet (5) of wrapping material folds into a U-shape inside the pocket (14) and has an outer end (8) projecting from the pocket (14) and from the group (2) of cigarettes, and an inner end (9) resting on a first lateral wall (6*a*) of the group (2) of cigarettes;

a first folding device for folding the inner end (9) 90° with respect to the first lateral wall (6*a*) of the group (2) of cigarettes, so the inner end (9) is perpendicular to the first lateral wall (6*a*) and projects perpendicularly from an intermediate portion of the first lateral wall (6*a*);

a second folding device (21) for folding the outer end (8) into an L-shape onto the first lateral wall (6*a*) of the group (2) of cigarettes and onto the inner end (9) perpendicular to the first lateral wall (6*a*), so as to superimpose the outer end (8) and the inner end (9) and impart a tubular shape to the sheet (5) of wrapping material; and a sealing device (24) for heat sealing the outer end (8) and inner end (9) to each other.

* * * * *